US007090088B2

(12) United States Patent
von Holdt, Jr.

(10) Patent No.: US 7,090,088 B2
(45) **Date of Patent: *Aug. 15, 2006**

(54) PLASTIC CONTAINER AND LID CONSTRUCTION

(76) Inventor: John W. von Holdt, Jr., 3121 Mary Kay La., Glenview, IL (US) 60025

( * ) Notice: Subject to any disclaimer, the term of this patent is extended or adjusted under 35 U.S.C. 154(b) by 182 days.

This patent is subject to a terminal disclaimer.

(21) Appl. No.: 10/722,169

(22) Filed: Nov. 25, 2003

(65) Prior Publication Data

US 2004/0112906 A1 Jun. 17, 2004

Related U.S. Application Data

(60) Continuation-in-part of application No. 10/621,549, filed on Jul. 17, 2003, which is a continuation-in-part of application No. 10/600,250, filed on Jun. 20, 2003, now abandoned, which is a division of application No. 09/925,246, and a continuation of application No. 09/925,246, filed on Aug. 8, 2001, now Pat. No. 6,619,498, which is a continuation of application No. 09/492,199, filed on Jan. 27, 2000, now abandoned.

(51) Int. Cl.
*B65D 17/40* (2006.01)
*B65D 41/48* (2006.01)

(52) U.S. Cl. ..... 220/276; 220/266; 220/270; 220/784

(58) Field of Classification Search ..... 220/265, 220/266, 270, 276, 780, 782, 784, 657
See application file for complete search history.

(56) References Cited

U.S. PATENT DOCUMENTS 3,881,627 A * 5/1975 Davolt ..... 215/329
4,210,258 A 7/1980 von Holdt
4,308,970 A 1/1982 von Holdt
4,375,948 A 3/1983 von Holdt
4,380,305 A 4/1983 von Holdt
4,444,332 A 4/1984 Widen et al.
4,452,382 A 6/1984 von Holdt
4,512,493 A 4/1985 von Holdt
4,512,494 A 4/1985 von Holdt
4,574,974 A 3/1986 von Holdt
4,735,337 A 4/1988 von Holdt
4,930,656 A 6/1990 Blanchette
5,373,955 A * 12/1994 Marino ..... 215/256
5,437,386 A 8/1995 von Holdt
5,460,287 A * 10/1995 Cargile et al. ..... 220/276
5,538,154 A 7/1996 von Holdt
5,617,968 A * 4/1997 Luburic ..... 220/276
5,730,309 A 3/1998 Jiradejnunt et al.
6,279,774 B1 * 8/2001 Clute et al. ..... 220/792
6,619,498 B1 * 9/2003 von Holdt, Jr. ..... 220/276
6,644,491 B1 * 11/2003 Dewig et al. ..... 220/276
6,688,483 B1 * 2/2004 Davis ..... 220/276
6,779,676 B1 * 8/2004 Ciccone ..... 220/276

* cited by examiner

*Primary Examiner*—Nathan J. Newhouse
*Assistant Examiner*—Niki M. Eloshway
(74) *Attorney, Agent, or Firm*—Banner & Witcoff Ltd.

(57) ABSTRACT

A combination molded plastic bucket and lid includes a series of outwardly extending ribs on the top edge of the bucket and inwardly extending flanges on a depending outer skirt of the lid which engaged with the bucket ribs to provide a wedging action that holds the lid tightly in a sealing position on the top of the bucket. A zig-zag tear strip permits removal of a portion of the lowermost lid flange. The top of the bucket includes a groove adapted to receive a projection or tongue seal.

50 Claims, 11 Drawing Sheets

FIG. 1
(PRIOR ART)
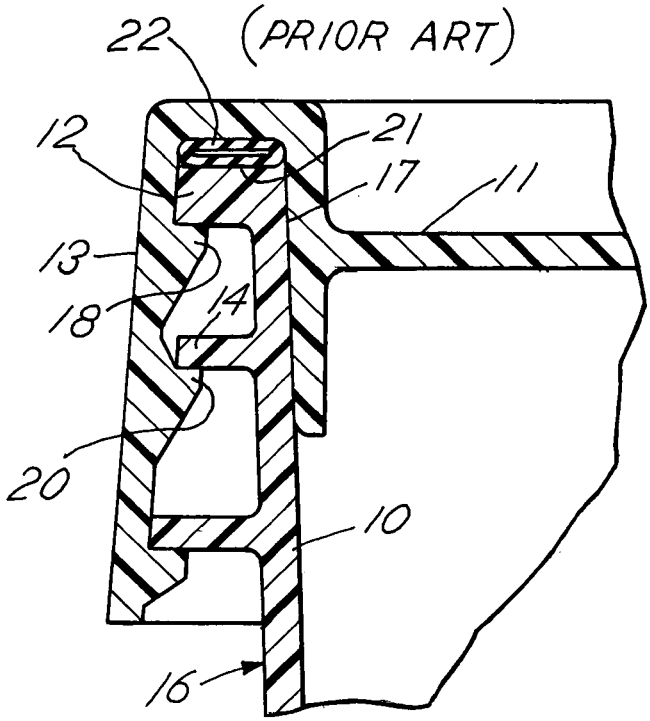
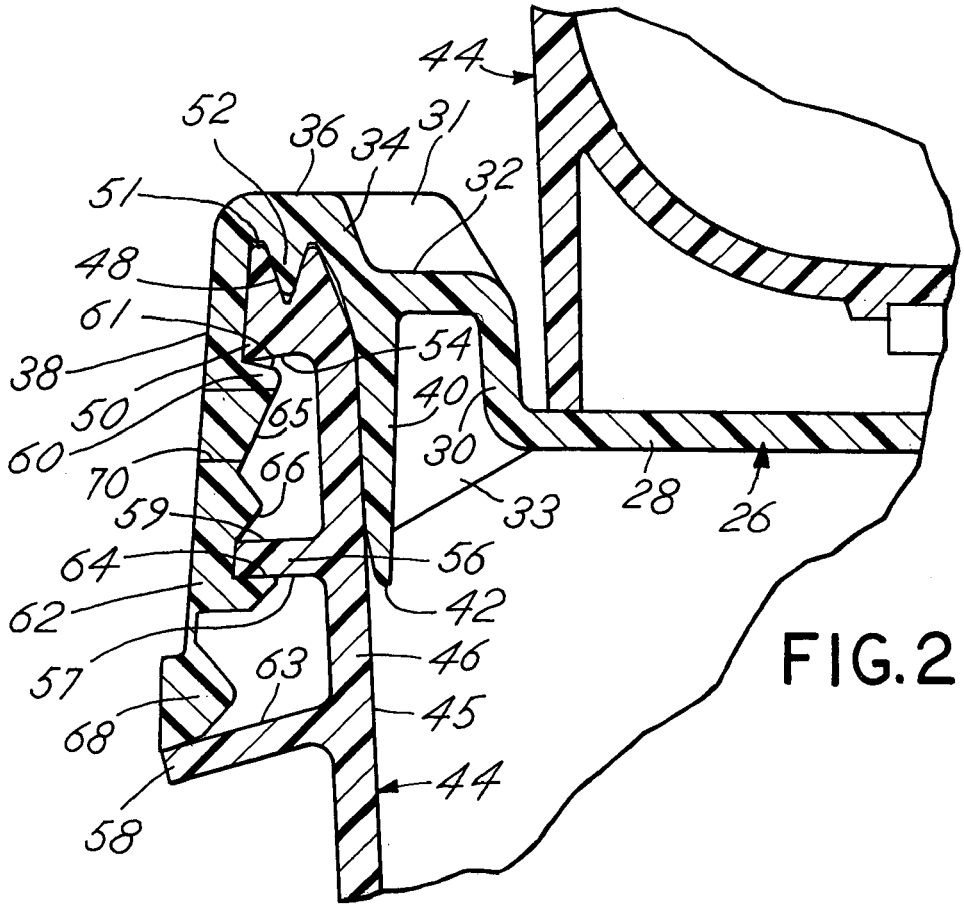
FIG. 2

PLASTIC CONTAINER AND LID CONSTRUCTION

CROSS REFERENCE TO RELATED APPLICATIONS

This application is a continuation in part application of application Ser. No. 10/621,549 entitled "Plastic Container and Lid Construction" filed Jul. 17, 2003 which is a continuation in part application of Ser. No. 10/600,250 filed Jun. 20, 2003 entitled "Plastic Container and Lid Construction", now abandoned, and which is a division (continuation) of Ser. No. 09/925,246 filed Aug. 8, 2001 (now U.S. Pat. No. 6,619,498) entitled "Plastic Container and Lid Construction" which is a continuation of application Ser. No. 09/492,199 filed Jan. 27, 2000 (now abandoned) entitled "Plastic Container and Lid Construction", each of which is incorporated herewith by reference and for which priority is claimed.

BACKGROUND OF THE INVENTION

The present invention relates to a molded plastic container or bucket and a compatible lid wherein the lid is removably secured to the open end of the container.

Many designs of molded plastic buckets or containers are known, for example, as disclosed in the following patents of John W. Von Holdt, Sr.: U.S. Pat. Nos. 4,375,948; 4,574,974; 4,512,494; 4,512,493; 4,452,382; 4,380,305; 4,308,970; and 4,210,258. Buckets or containers for food, paint, solvents and chemicals have been made from molded plastic materials in accord with the teachings of such patents. However, molded plastic buckets may lack the strength of buckets fabricated from metal. Thus special designs for plastic buckets may be adopted to obtain, for example, desired structural integrity, hoop strength and stacking strength. Hoop strength relates to the function or characteristic of the container to resist lateral deformation or change in the cross sectional shape of the container when lateral forces act upon the sides of the container. Stacking strength relates to the function or characteristic of the container to support vertical loads such as those which may occur when containers are stacked upon each other.

Also the design of the mouth or open end of a plastic bucket or container and a compatible lid presents a challenge to provide a lid that is properly retained and sealed on the open top of the bucket. VonHoldt in U.S. Pat. No. 5,538,154 entitled Snap-OnFlexible Lid discloses a plastic lid with a peripheral flange constructed to enhance the "drop strength" of the lid while retaining flexibility adequate to permit removal of the lid from a container. Drop strength relates to the function or characteristic of the lid to maintain attachment to a container even when dropped from various heights. Von Holdt in U.S. Pat. No. 5,437,386 entitled Container with Tamper-Evident Lid Removal Means discloses additional embodiments of compatible molded plastic bucket and lid constructions.

Attachment of a lid to the open end of a molded plastic bucket often involves frictional or interference engagement or interaction between a rib, lip or groove molded in the open end of the bucket and a circumferential flange projection or groove in the lid. For example, the lid may include a radially, inwardly extending flange, rib or lip that is engaged with an outwardly extending rib on the outside wall of the bucket. A typical prior art lid and bucket combination is depicted in the cross section in FIG. 1. A bucket side wall 10 includes two circumferential, outwardly extending radial ribs 12, 14 which are each cooperative with a separate, inwardly extending circumferential, radial flange, 18, 20 on a skirt 13 of the lid 11. Flanges 18, 20 fit over the bucket ribs 12, 14 and thereby hold or retain the lid 11 on the bucket. The flanges 18, 20 resist release or removal of the lid 11 from the top or open end of the bucket.

Such prior art constructions work well. However, the need for a tamper resistant, improved lid construction for use in combination with a molded plastic bucket has remained.

SUMMARY OF THE INVENTION

In a principal aspect, the present invention comprises a molded plastic bucket or container and a compatible lid combination wherein the bucket includes at least two, radially outwardly extending, generally horizontal flanges or ribs at the top or open end of the bucket, and wherein the lid includes a depending skirt with at least two inwardly extending flanges or ribs that cooperate with the bucket ribs by engaging the bucket ribs. In this manner, the lid is held by cooperative engagement of the lid flanges with the bucket ribs. Further, the lid includes a downwardly extending, circumferential tongue adapted to fit in a circumferential groove in the top edge of the bucket. The profile of the inside of the depending skirt of the lid is shaped to thwart tampering with the seal of the lid on the container. A removable tear seal is also incorporated in skirt of the lid. The tear seal has a zigzag shape which enables removal of portions of the lower lid flange when the seal is removed Thus it is an object of the invention to provide an improved molded plastic bucket and lid combination.

A further object of the invention is to provide a molded plastic bucket with outwardly projecting lid retention ribs at the open end of the bucket and a lid with inwardly extending ribs or flanges that hook over the bucket ribs to thereby effect sealing and retention of the lid on the bucket.

Another object of the invention is to provide a bucket design and lid construction which is tamper resistant and which can be made from molded plastic.

Another object of the invention is to provide a molded plastic bucket and lid wherein multiple buckets each closed by a lid may be easily stacked.

A further object of the invention is to provide a combination molded plastic bucket and separable lid wherein the lid includes an improved seal.

Another object of the invention is to provide a combination plastic bucket and lid which incorporates multiple points of contact to effect a seal between the open end of the bucket and the lid.

A further object of the invention is to provide a bucket and lid made from molded plastic which is economical to manufacture, may be made for a reasonable cost of materials, and which has necessary structural integrity and strength, including hoop strength, stacking strength and drop strength.

These and other objects, advantages and features of the invention are set forth in the detailed description which follows.

BRIEF DESCRIPTION OF THE DRAWING

In the detailed description which follows, reference will be made to the drawing, comprised of the following figures:

FIG. 1 is a cross sectional view of a typical prior art lid construction for a molded plastic bucket;

FIG. 2 is a cross sectional view of a first embodiment of the lid and bucket construction of the present invention;

DESCRIPTION OF THE PREFERRED EMBODIMENT

Figure 3:
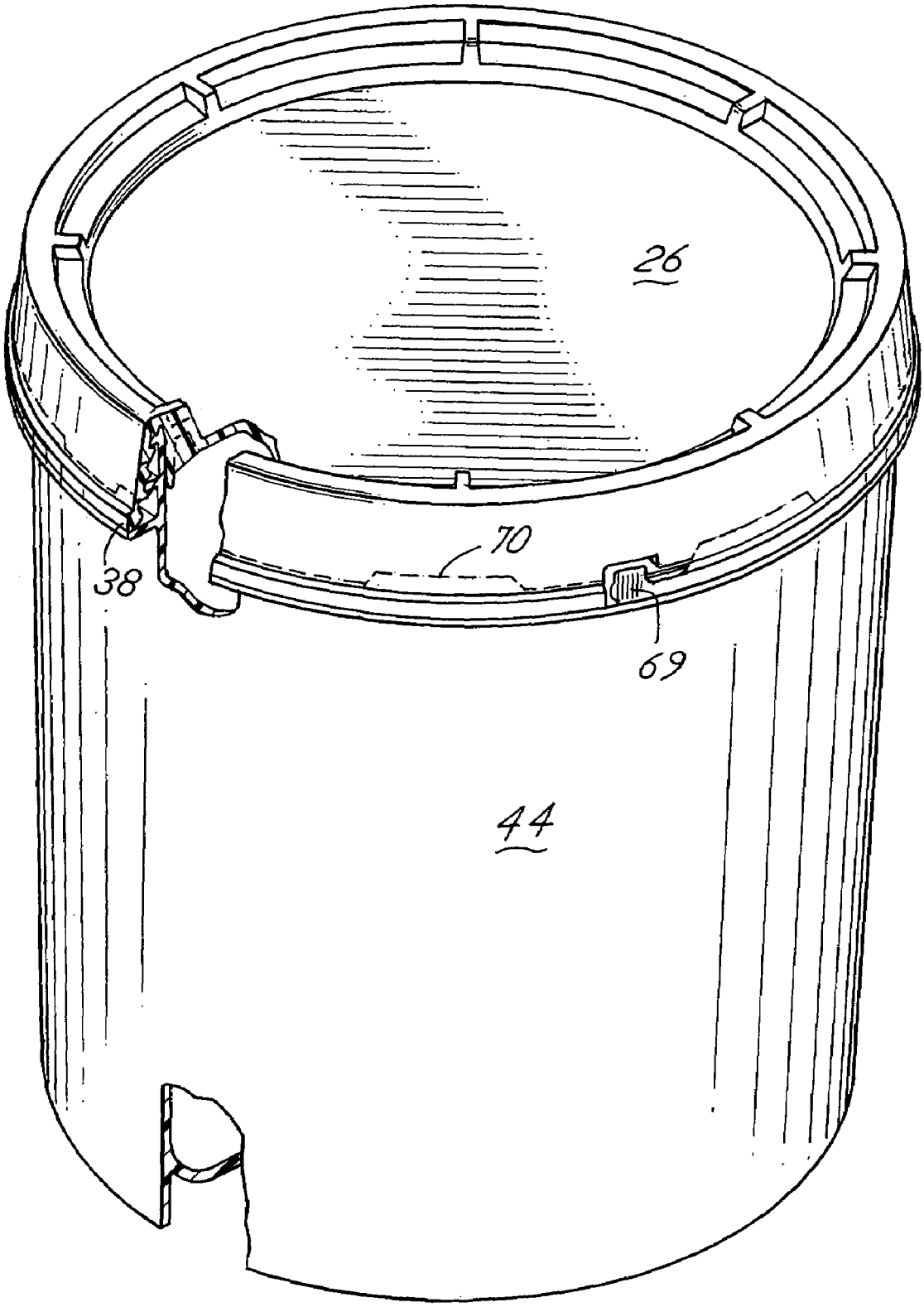
FIG. 3 is an isometric view of the embodiment of the lid and bucket construction of the invention as depicted in FIG. 2 illustrating the attachment of the lid to the bucket.

FIG. 1 illustrates a typical prior art lid 11 and bucket or container 16. The lid 11 includes a depending flange or skirt 13 with radially inwardly extending ribs or flanges 18, 20 that cooperate with radially outwardly extending ribs 12, 14 associated with the top or open end 17 of the side wall 10 of bucket 16. Rib 12 is at the extreme upper, open end 17 of the bucket 16 and has a generally rectangular cross section. Rib 12 extends around the entire circumference of the bucket, pail, or container 16. Similarly, the lower rib 14 extends around the circumference of bucket side wall 10 of bucket 16.

The ribs 12 and 14 are vertically spaced from one another and preferably are continuous with a uniform cross section about the circumference of the bucket 16. The inwardly extending, locking ribs or flanges 18 and 20 of the lid 11 are similarly spaced and engage respectively under the bucket ribs 12 and 14 to hold the lid 11 tightly on bucket 16. An optional flexible gasket 22 may be provided to seal the bottom of lid 10 against upper surface 21 of the outwardly radially extending rib 12 of bucket 16. The container 16 and lid 11 are fabricated from molded plastic material.

FIGS. 2–5 depict a first embodiment of an improved lid 26 and a compatible bucket, pail or container 44. Referring to those figures, lid 26 includes a recessed central panel or section 28 which connects with an upwardly extending, vertical wall or hoop 30 that extends around the circumference of the central section 28. The hoop 30 is integrally connected to a radially outwardly extending annular, planar section 32. The annular section 32 further connects with an upwardly and outwardly extending, inclined wall or hoop section 34 which, in turn, connects with a radially outwardly extending annular planar section 36, connected to a downwardly extending skirt 38 described in greater detail below.

Upwardly and downwardly extending vertical reinforcing fillets 31, 33 respectively are optionally provided at spaced intervals about the periphery of section 32. Fillets 31, 33 function to stiffen the lid 26 including the hoops 30, 34. The lid 26 further includes a downwardly extending, internal lip or flange 40 which projects vertically downwardly from hoop 34 and is parallel to and spaced outwardly from the hoop 30 so that flange 40 will fit against the inside side surface 45 of bucket side wall 46. The flange 40 thus defines another hoop and further functions as an inside lid seal. The flange 40 is, in cross section, in the form of a wedge with a narrow portion of the wedge at the lower end 42 of the flange 40. This shape facilitates sealing of and positioning of the lid 10 onto container or bucket 44 since flange 40 is wedged into engagement with the inside surface 45 of vertical, bucket side wall 46 at the upper end or open end of the bucket 44. The flange 40 is flexible or elastic to promote sealing. Fillets 33 spaced about the circumference of flange 40 insure the flange 40 will be biased toward the wall 46 to effect a seal on surface 45.

The bucket 44 includes an upper, circumferential, outwardly extending, horizontal rib 50. Horizontal top surface 51 of the rib 50 includes a groove or channel 52 for receipt of a downwardly extending tongue or wedge seal 48 of lid 26. In the preferred embodiment, the channel 52 and the seal 48 are fully circumferential. However, other configurations are possible so long as the seal 48 and channel 52 are compatible and provide a sealing function. The radial or horizontal spacing of seal 48 and flange 40 is chosen to enhance a sealing and wedging, grasping or gripping function of the lid 26 onto the bucket 44. An alternative to the seal 48 and groove 52 comprises a compressible seal (not shown) fitted against the top surface 51 of rib 50 similar to the seal of FIG. 1.

The upper rib 50 includes a circumferential, inwardly extending, lower land 54 which acts as a contact surface for a portion of the lid 26 as described below. Spaced vertically downwardly from the radially extending rib 50 on the outside of the bucket side wall 46 is a second circumferential rib 56 which includes a lower, horizontal land 57. As an optional feature, a third generally radial, outwardly extending rib 58 projects from the outside of the bucket side wall 46 for further cooperation with the lid 26. Rib 58 includes an inclined upper land 63.

The lid 26 includes a first inwardly extending locking rib or flange 60 attached to the downwardly extending, outer skirt 38. The locking flange 60 includes a surface 61 which engages against the lower land 54 of bucket rib 50 to tightly retain the lid 10 in position on bucket 44.

The skirt 38 further includes a second, inwardly extending flange 62 which provides a first, latching surface 64 and a second, inwardly inclined face 66. The face 66 extends over a top land or surface 59 of the bucket rib 56. It is noted that the locking flanges 60 and 62 engage respectively with parallel, spaced surfaces 54, 57 of the radially outwardly extending ribs 50, 56 at the mouth of the bucket 44. Thus, the lid flanges 60 and 62 are, in essence, wedged against the ribs 50 and 56 respectively as a result of their spacing and configuration.

Figure 4:
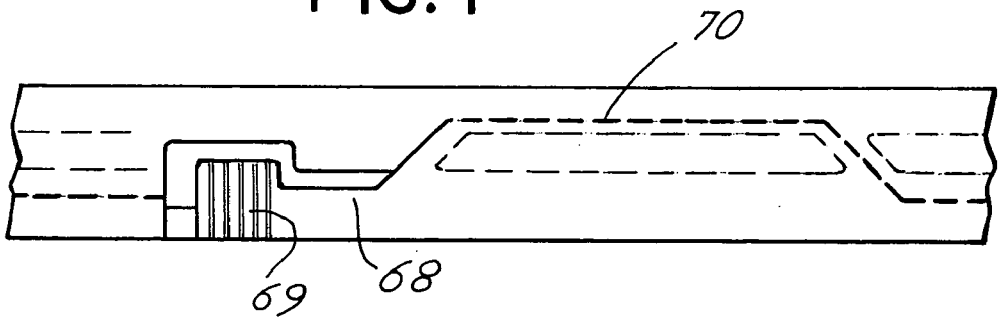
FIG. 4 is an enlarged isometric view of the security release strip associated with the lid of the embodiment of FIG. 2.
Figure 5:
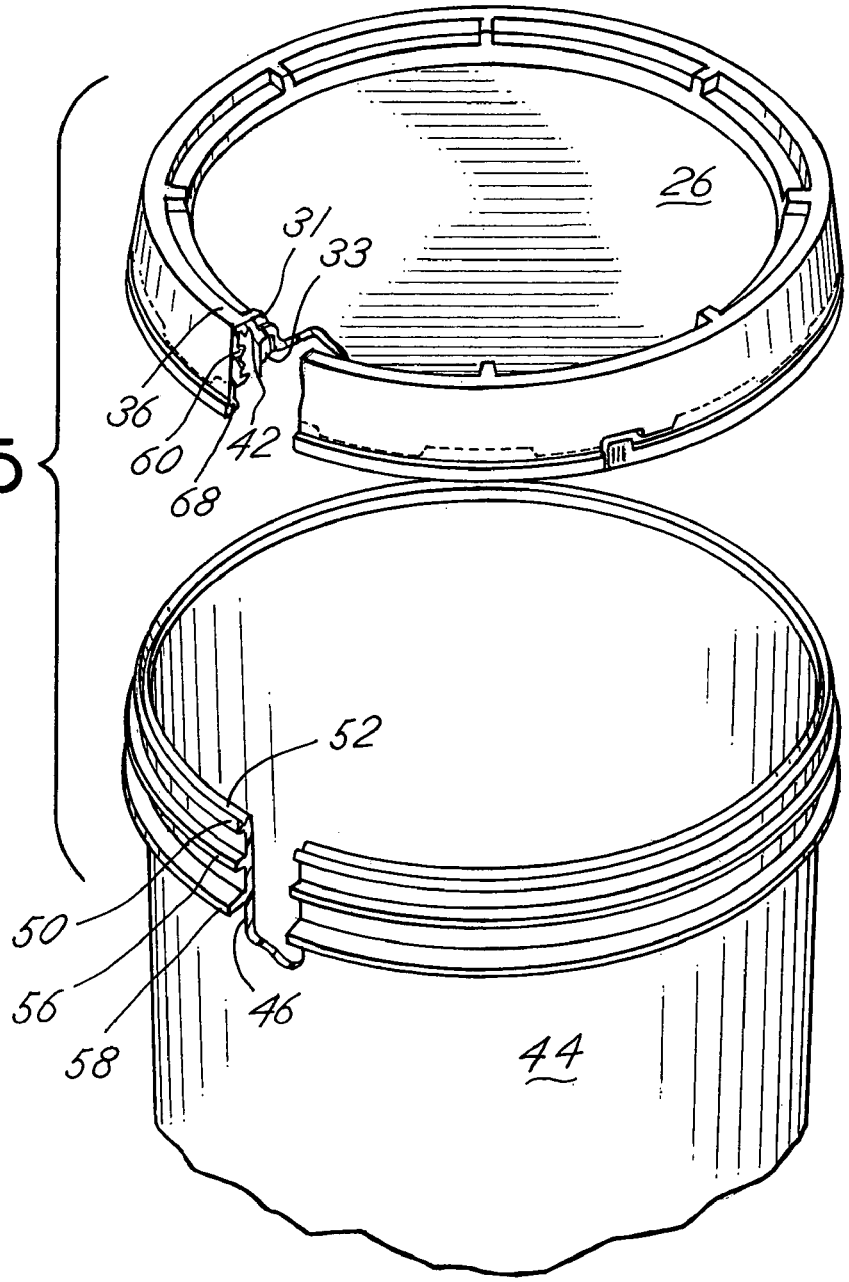
FIG. 5 is an exploded, isometric view of the embodiment of FIG. 2.
Figure 6:
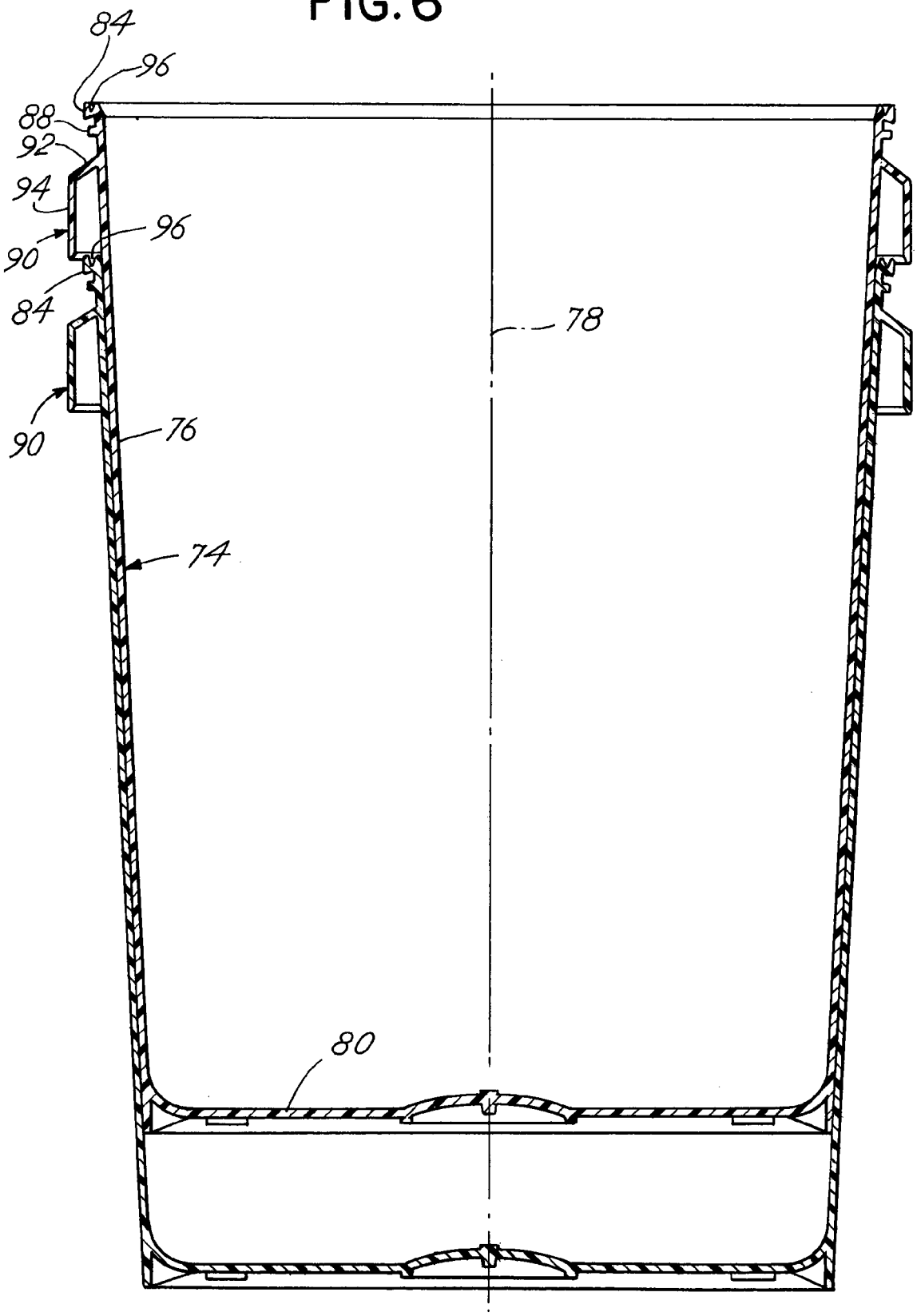
FIG. 6 is a cross sectional view of an alternative embodiment of the invention depicting the manner of stacking multiple unfilled containers or buckets.

A further feature comprises a third inwardly extending rib or flange 68 of lid 26 attached to bottom of the skirt 38. Flange 68 extends inwardly to engage against or be positioned adjacent the top surface 63 of the radially outwardly and downwardly extending rib 58 of the bucket 44. The flange 68 is preferably connected to the skirt 38 along a zigzag tear strip boundary 70 so that a tab 69 molded to provide a free end of flange 68 may be gripped and a tear strip, defined by rib 68 and portions of rib 62, may be removed or torn away from the skirt 38 to enable the lid 26 to be removed from the bucket 44. As depicted in FIGS. 3–5, the tear strip incorporates the rib or flange 68 as well as portions of rib or flange 62. Removal of the tear strip releases the holding force associated with those portions of flange 62 that have been removed. The described configuration therefore facilitates ease of removal as well as replacement of a lid 26 on an open container 44. Also, if flange 68 is subjected to undesired tampering, the flange 68 will tear along a boundary 70 and thus tampering may be evidenced.

In review, the optional wedge seal 48 that fits in the channel 52 enhances sealing of the lid 26 to the bucket 44. Additionally, the downwardly extending flange 40 serves to seal the lid 26 to the bucket 44. The bridging planar radial section 36 connecting the flange 40 and skirt 38 is elastic and deformable so as to enable the skirt 38 to be deformed to permit removal of the lid 26. The inwardly extending flanges 60, 62 and 68 are defined by angled surfaces which facilitate the movement or attachment of the lid 26 by virtue of a snap action wherein the flange or skirt 38 will deform elastically and then snap the various flanges 60, 62 into position to appropriately engage ribs 50,56 of the bucket and wedge the lid 26 against the top of the bucket 44. The angled walls (e.g., face 66 of flange 62) defining the flanges 60, 62 further facilitate the removal and subsequent replacement of the lid 26 after the tear strip has been removed. Face 65 below flange 60 has a similar function.

As depicted in the drawing, the lid 26 includes a recessed central section or panel 28. This panel 28 enables buckets 44 to be stacked one upon the other inasmuch as the side wall 46 of each bucket 44 has, or may have, a draft angle and thus the lower end of the bucket 44 is sized to fit on top of the lid 26 in the area defined by the central section or panel 28.

With the lid construction of the present invention, the wedging and locking functions associated with the design of the edge or skirt of the lid 26 provide an improved and more permanent seal of the lid 26 to the bucket. The use of two inwardly extending flanges to provide a wedging and locking function is preferred along with a zig-zag tear seal which permits removal of part of flange 62. However, it is possible to vary the number of lid flanges and bucket ribs, and to vary positioning of the ribs vertically along the side of a bucket wall in combination with inwardly extending flanges shaped in various configurations and tear strips associated with the lid 26. The sealing channel 52 in the bucket top also may be varied. That is, the channel 52 in bucket 44, which cooperates with the downwardly depending circumferential rib 48 of the lid, may be replaced by a gasket seal of some type, for example. Also, the ribs and flanges are described as continuous, but may be discontinuous. The zig-zag tear seal may also vary in configuration and include one or more flanges 60, 62, 68.

Referring next to FIGS. 6–11, there is illustrated an alternative embodiment of the lid and bucket construction of the invention. A bucket 74 includes a sidewall 76 which is made from molded plastic material and defines a generally frustoconical section about a vertical axis 78. The bucket sidewall 76 extends from the bottom 80 of the bucket upwardly and terminates with the open top 82.

The open top 82 includes a circumferential, first upper rib 84 with a depending groove 86 in the top surface thereof. Spaced from rib 84 is a second rib 86 which extends about the outside circumference of the wall 76.

Positioned below the flange or rib 88 is a depending skirt 90 having an outwardly and vertically downwardly inclined face 92, a generally vertical wall 94 and a connecting inwardly extending molded land or planar section 96 connected to the wall 76. The molded wall 76 in combination with the skirt 90 functions to provide enhanced hoop strength to the container 74.

Figure 7:
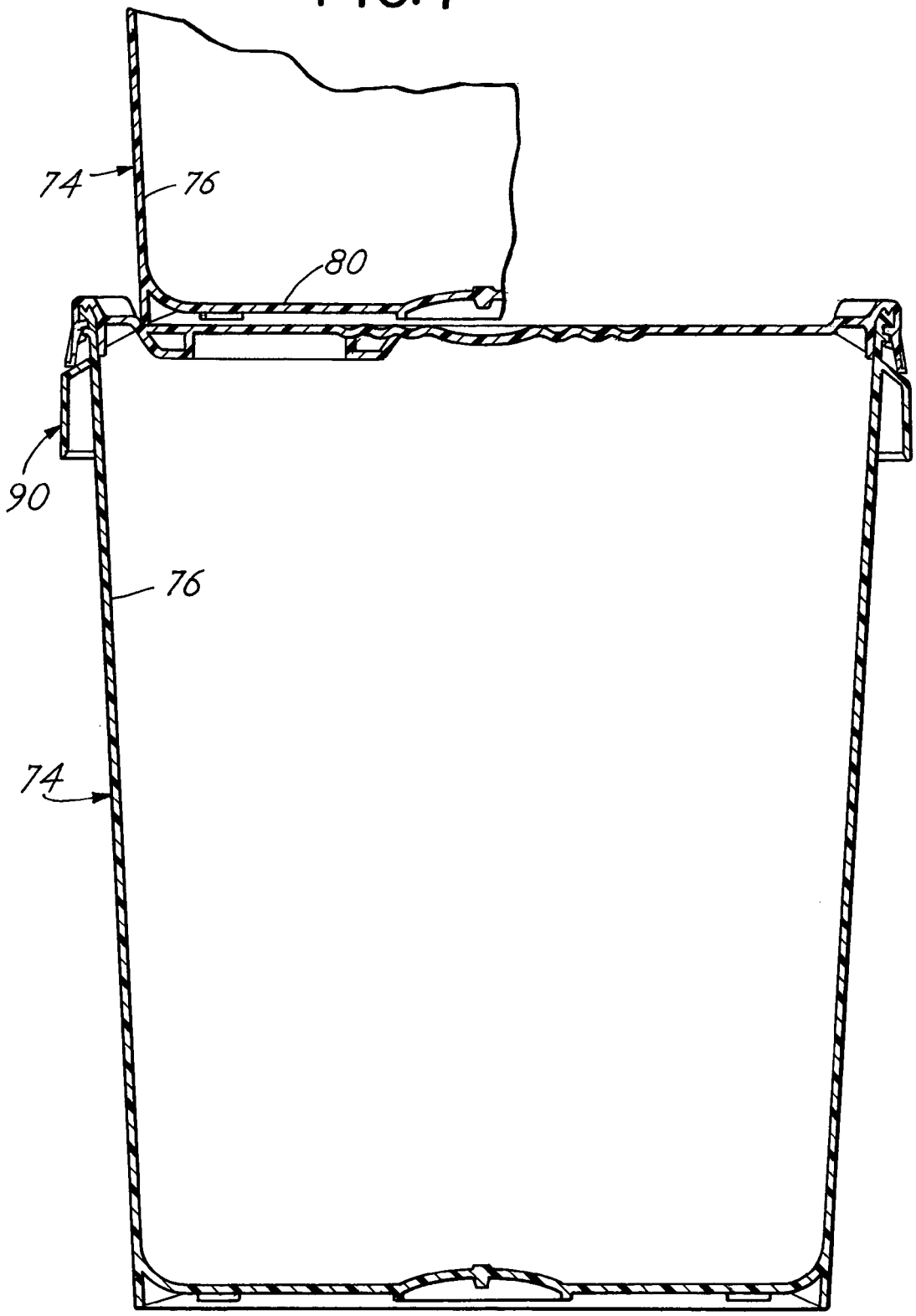
FIG. 7 is a cross sectional view of the bucket of FIG. 6 with a compatible lid.
Figure 8:
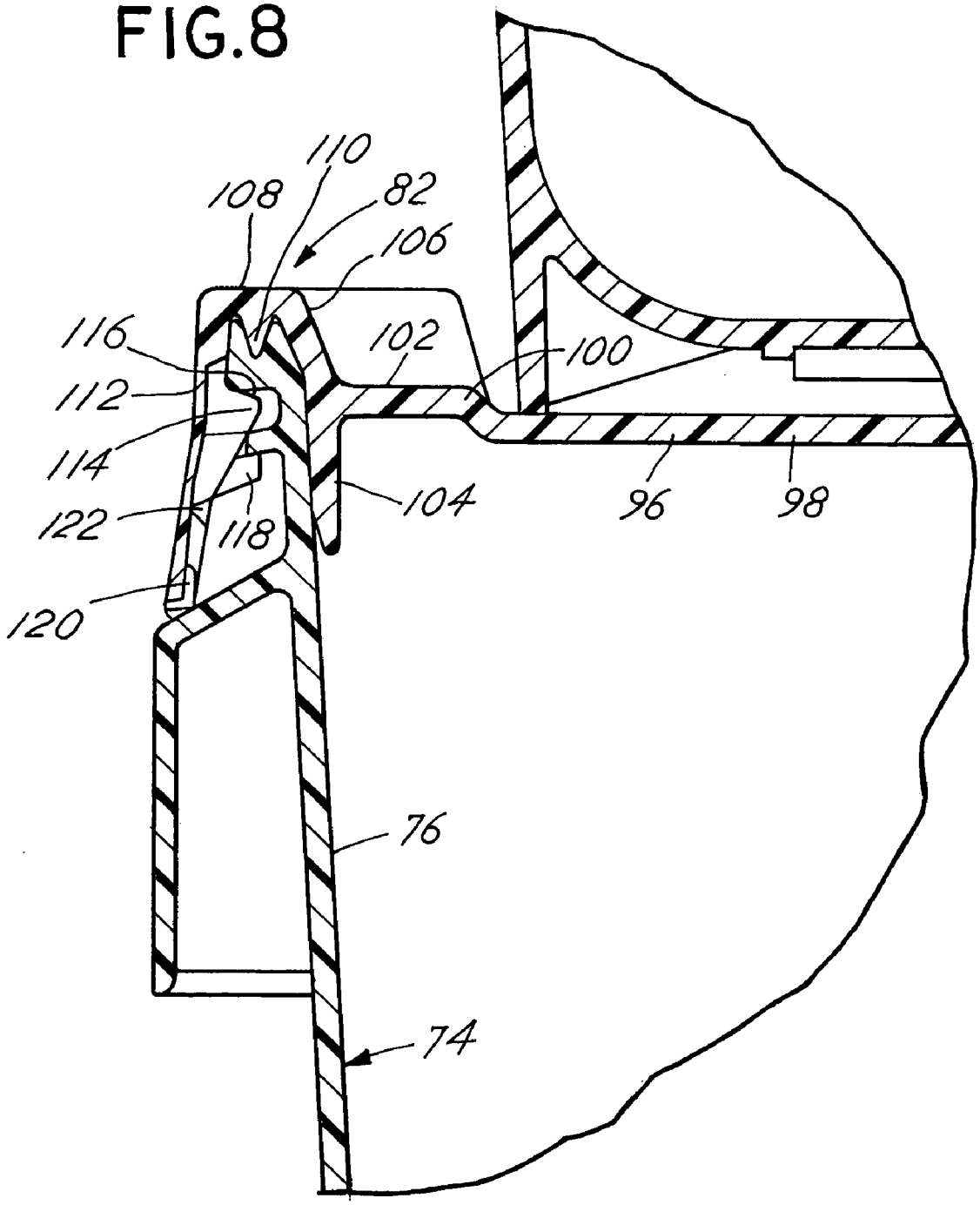
FIG. 8 is an enlarged partial cross sectional view of the lid and bucket construction of FIG. 7.

As depicted in FIGS. 7 and 8, the upper end 82 of the side wall 76 is designed to be used in combination with a lid 96. The lid 96 includes a center circular panel or section 98 which is connected by an inclined annular section 100 to a generally horizontal annular section 102. The annular section 102 connects to a downwardly depending inner circumferential flange 104 and upwardly extending inclined outward extending hoop 106. The hoop 106 further connects with an annular planar section 108 which extends generally horizontally outwardly and perpendicular to the axis 78 when the bucket is in the configuration or orientation depicted in FIG. 6. The annular section 108 includes a downwardly extending tongue seal 110 which fits into the recessed groove 86.

Figure 9:
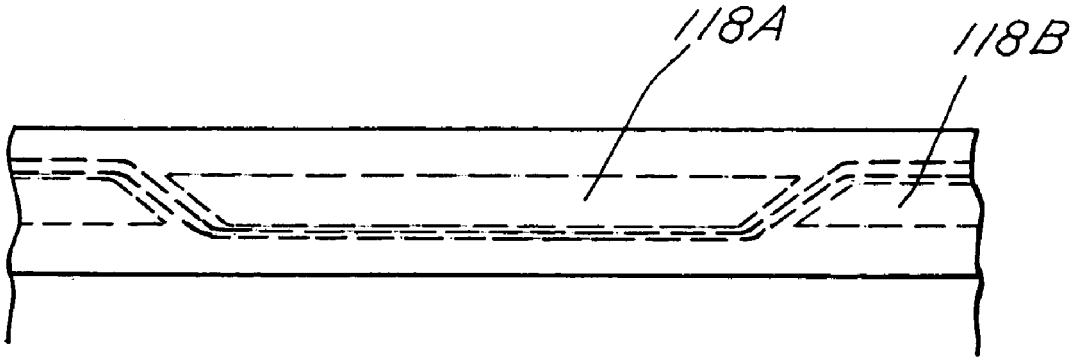
FIG. 9 is partial side elevation of the lid of the embodiment of FIG. 7 illustrating the lid tear strip.
Figure 10:
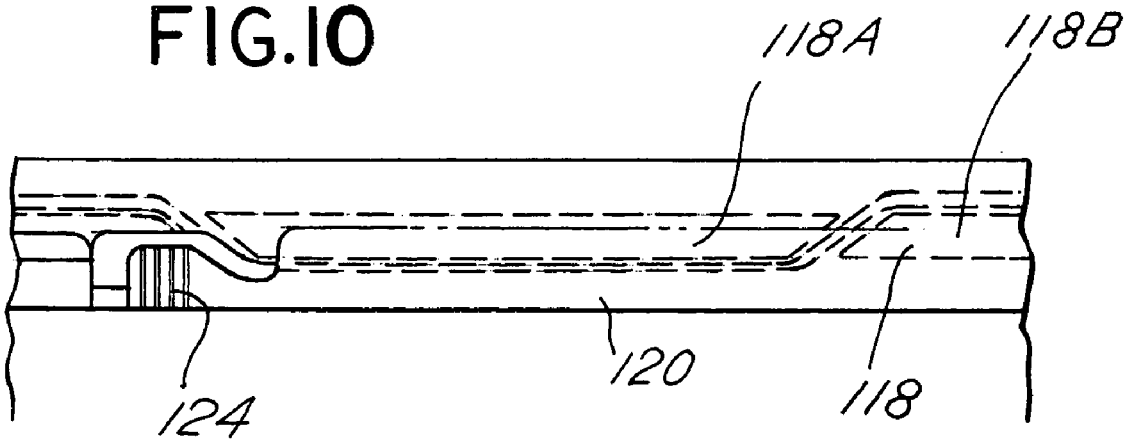
FIG. 10 is a partial side elevation of the lid of the embodiment of FIG. 7 illustrating an end of the lid tear strip.
Figure 11:
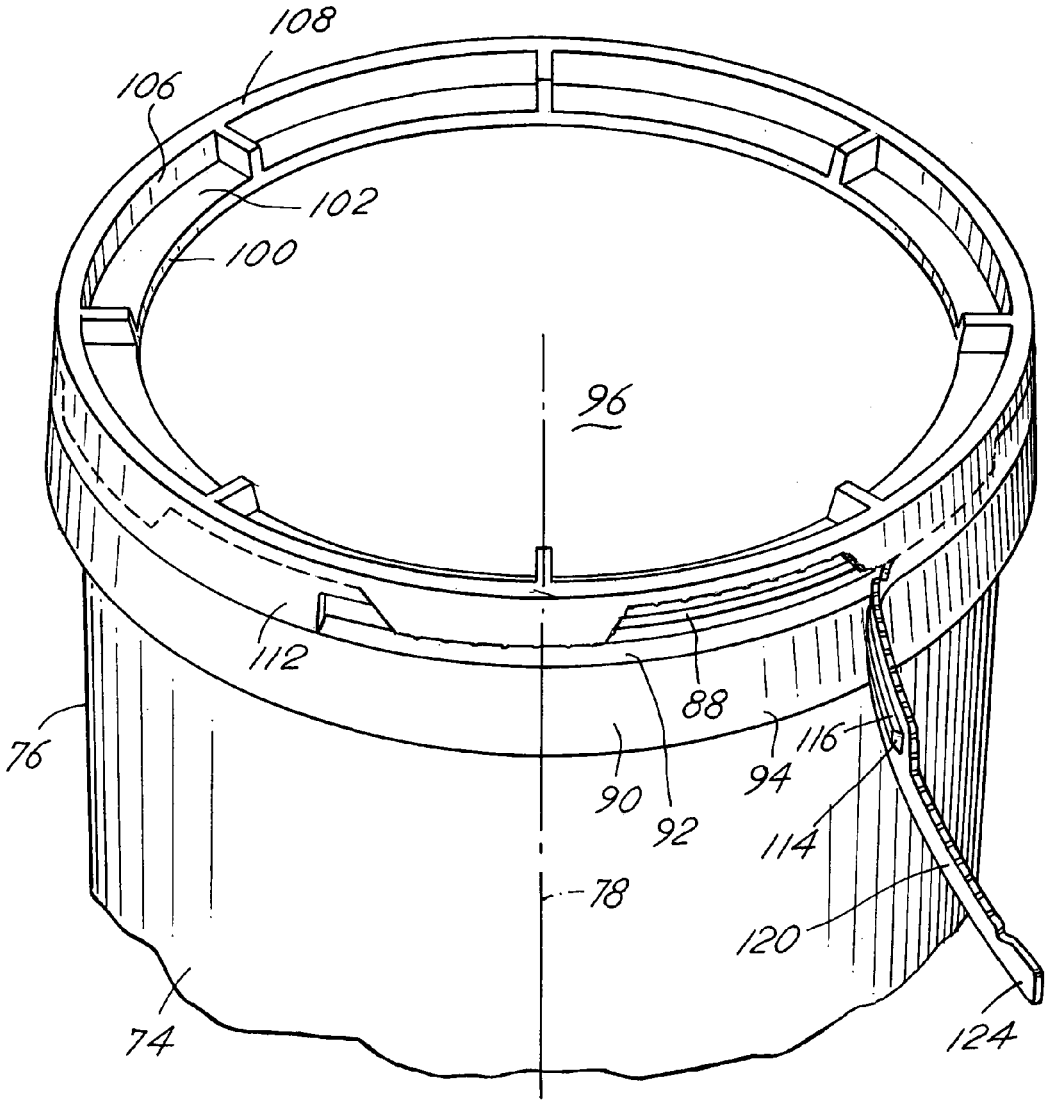
FIG. 11 is an isometric exploded view of a bucket and lid of FIG. 7 with the tear strip partially removed.

The lid of 96 further includes a depending skirt 112 spaced from the flange 104 and extending downwardly from annular section 108. The skirt 112 includes a first, circumferential, inwardly extending flange 114 having a flange surface 116 which engages against the underside of the rib 84. The skirt 112 further includes a second circumferential inwardly extending rib member or flange 118 which cooperates with the bucket rib 88 by engaging the underside thereof. The skirt 112 further includes a downwardly depending section or extension or strip 120 which is connected to the skirt 112 along a junction 122 to define a zigzag tear strip 120 as depicted in greater detail in FIGS. 9 and 10. As shown in FIGS. 9 and 10, the tear strip 120 has a zigzag pattern and incorporates portions or circumferentially spaced segments of the flange 118. Thus, the flange 118 is defined by a series of connected segments such as 118A and 118B in FIGS. 9 and 10. The segments 118A and 118B of the flange 118 are separated by a thin molded portion in the skirt 112 so as to enable removal of the tear strip 120 by gripping or pulling end tab 124 to thereby remove those rib sections 118B maintained on the tear strip 120.

The embodiment of FIGS. 6 through 11 functions in a manner similar to that of the embodiment of FIGS. 2–5. That is the inwardly extending flanges 118 of the lid 96 cooperate with outwardly extending ribs 88 of the bucket 74. A zig-zag tear strip is provided which, when removed, eliminates a portion of the locking effect provided by the lower inwardly extending flange 118. Thus, the combination includes a zig-zag tear strip and a double locking flange and rib configuration. The combination may further include a downwardly extending tongue 110 of a lid 96 which cooperates with a groove in the top of the bucket. Enhanced hoop strength is provided by the configuration of the elements comprising the lid as well as the elements comprising the open end of the container or bucket. The lid incorporates an arrangement of circular spaced hoops which may be elastically deformed to effect engagement and locking with the open end of the container or bucket. The various hoops provide hoop strength yet also permit appropriate deformation for removal and replacement of the lid.

Figure 12:
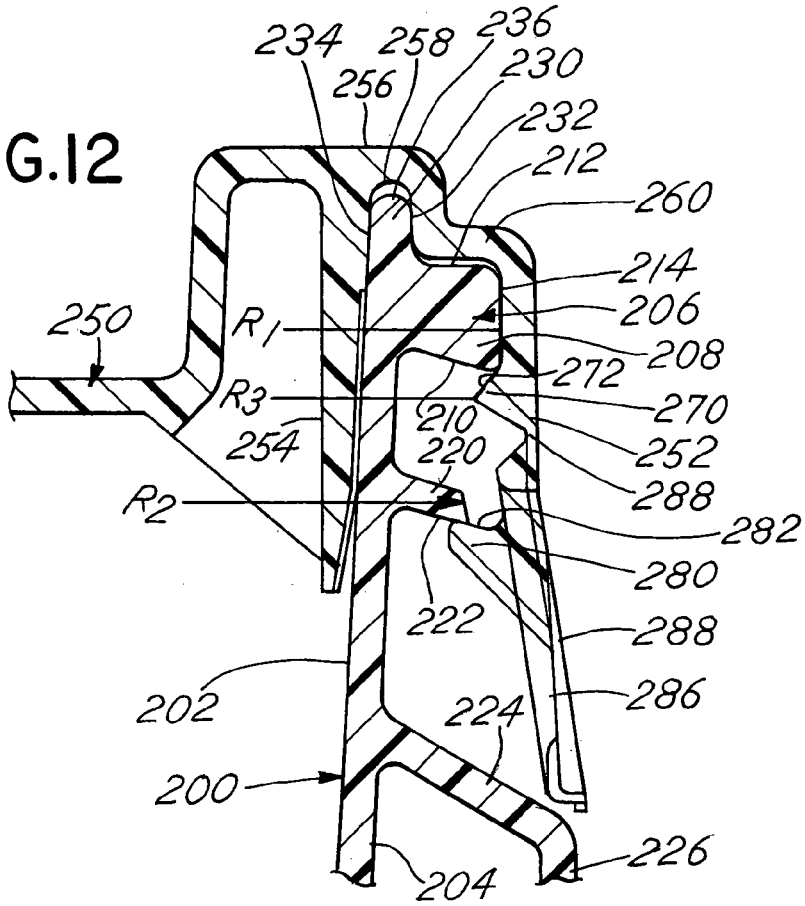
FIG. 12 is a partial cross sectional view of an alternate design of the bucket rim and lid rim or periphery.
Figure 13:
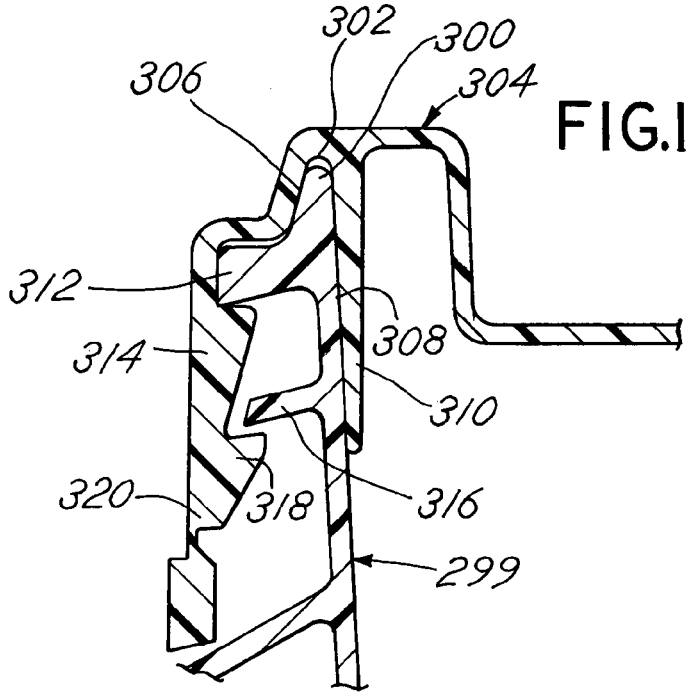
FIG. 13 is a partial cross sectional view of an alternate design of the bucket rim and lid rim or periphery.

FIGS. 12 and 13 illustrate further alternative embodiments of the construction of the periphery of the lid and the compatible rim of a bucket. Referring first to FIG. 12, a bucket 200 includes a cylindrical or generally cylindrical bucket side wall 202 having an outer face or surface 204. The bucket 200 further includes a rim 206. The rim includes a circumferential, but outwardly projecting rib 208 having an underside or under surface 210 and a top surface 212 adjoined by an outwardly inclined depending generally vertical face 214. The top rib or flange 208 extends a first maximum radial distance $R_1$ from a centerline axis (not shown) of the bucket 200. The underside surface 210 is inclined downwardly from horizontal in the range of 50–15°.

A second outwardly extending rib 220 is spaced vertically downwardly from the first rib 208. The second rib 220 includes an underside or undersurface 222 which is generally parallel to the underside 210 of the first rib 208. Both undersurfaces 210 and 222 are inclined downwardly in the range previously disclosed. The second rib 220 includes a maximum outward radial extent $R_2$ from the centerline axis of the bucket. An optional third flange or rib member 224 positioned vertically downwardly from the second rib 220 may be included and may include a generally circular, downwardly extending outer extension 226 to provide additional hoop strength to the rim area of the bucket 200.

The rim 206 of the bucket 200 further includes an upwardly projecting tongue 230 having a first or outer sealing surface 232 and an inwardly spaced inward sealing surface 234. The inward or inner sealing surface 234 is the inside face of the bucket wall 202. The inner face 234 and the outer face 232 converge toward one another and are joined by an arcuate apex surface 236.

The periphery or rim of a lid 250 includes an outer flange 252 spaced from an inside skirt 254 both of which depend from a generally horizontal connecting section 256. The connecting section 256 comprises a groove 258 generally compatible or congruent in cross sectional shape with the tongue 230. However, the groove 258 is fabricated so that a slight space or separation exists between the top or apex 236 of the tongue 230 and the bottom of the groove 258. The side faces 232 and 234 of the tongue 230 engage or fit against the side surfaces of the groove 258 to provide a very good seal between lid 250 and bucket 200. The top extension of the lid 256 includes an outward run 260 in opposed relation to the rib 206 and, more particularly, to the top surface of the rib 206. This top extension 260 may be spaced slightly from the top side of the rib 206 inasmuch as the outer flange 252 or outer skirt 252 of the lid 250 is somewhat flexible or elastic and will be compressed or tend to flex inwardly toward the inner skirt 254 when the rim 206 of the bucket 202 is positioned within the peripheral section of the lid 250. In other words, the flexure of the outer skirt 252 and the extension or connection between that skirt 252 and inner skirt 254 of the lid 250 will compress to thereby effect the seal against the side surfaces of the tongue 230 and to fit tightly against the upper or first rib 208. In doing so, interference between the top surface of the rib 208 and the peripheral extension 260 of the lid 250 is minimized or avoided. This promotes the seal between the lid 250 and bucket 200.

The downwardly depending flange or skirt 252 further includes an inwardly extending flange or lid member comprising a first inwardly extending rib member 270. The first inwardly extending rib member 270 includes a downwardly and inwardly inclined surface 272 in opposed relation to the underside 210 of the first rib 208. The inclined surface 272 forms an acute angle with respect to the underside 210 of the first rib 208. The rib 270 extends inwardly toward the centerline axis of the bucket to a radial extent $R_3$ which radial extent is equal to or greater than the radial extent of the second rib 220; namely, radial extent $R_2$.

The outer skirt or flange 252 further includes a second inwardly extending flange or rib member 280. The flange or rib member 280 is spaced so that a top side surface 282 of the rib 280 will be in opposed relationship to the underside 222 of second rib 220. The surfaces 282 and 222 are in flush opposed relationship one to the other to provide an enhanced locking construction between lid 250 and bucket 200. A zig-zag tear strip 286 which provides zig-zag tearing along a line or partition 288 provides for removal of a strip of material from the lid 250. Removal of such a strip of material will effect removal of portions of the second inwardly extending rib 280 thereby removing the locking feature associated with the removed portion of the second rib 280. The rib 280 provides an enhanced locking feature relative to the lid 250 because of the angular relationship between the underside surfaces 222 and 210 of the second rib 220 and first rib 208, respectively, relative to the inwardly extending second flange or lid rib 280 and the first lid rib 270. Thus, by engineering the relationship of the construction of the ribs of the bucket 200 and the inwardly extending ribs of the lid 250 as well as the amount of tear strip 286 that is removed when the tear strip 286 is removed from the lid 250 or flange 252, one is able to control the effort required to replace the lid once the bucket is open and to then re-remove the lid from the bucket. Additionally, the utilization of providing a tongue member incorporated in the rim of the bucket for engagement with a groove in the peripheral section of the lid provides an enhanced resealing capability not previously observed with other relationships between a bucket 200 and lid 250.

FIG. 13 illustrates a slightly revised version of the construction of FIG. 12. In FIG. 13 the relationship of the angular sides of a tongue 300 to a groove 302 in a lid 304 is varied slightly. Nonetheless, a sealing surface or point 306 on one side of tongue 300 is provided and a sealing point or section 308 on the opposite side of the tongue is provided between bucket 299 and skirt 310 of lid 304. Again, a first rib 312 of the bucket engages a first rib 314 of the lid. A second rib 316 of bucket 299 cooperates with a second inwardly extending flange or rib 318 of lid 304. The radial relationships of the ribs and the engagement of the surfaces on the underside of the ribs 312 and 316 are as previously described for the embodiment of FIG. 12. A tear strip 320 is provided to remove sections of the outer flange of the lid 304 again such removal affecting the interaction between the second rib 316 of bucket 299 and the second rib 318 of the lid 304 as previously described. Thus, the embodiment of FIG. 13 illustrates a manner in which the relationship of the surfaces forming the ribs may be varied and a manner in which the construction of the tear strip as well as the tongue and groove construction of the bucket lid and the bucket may be varied slightly to remain within the scope and spirit of the invention.

Figure 14:
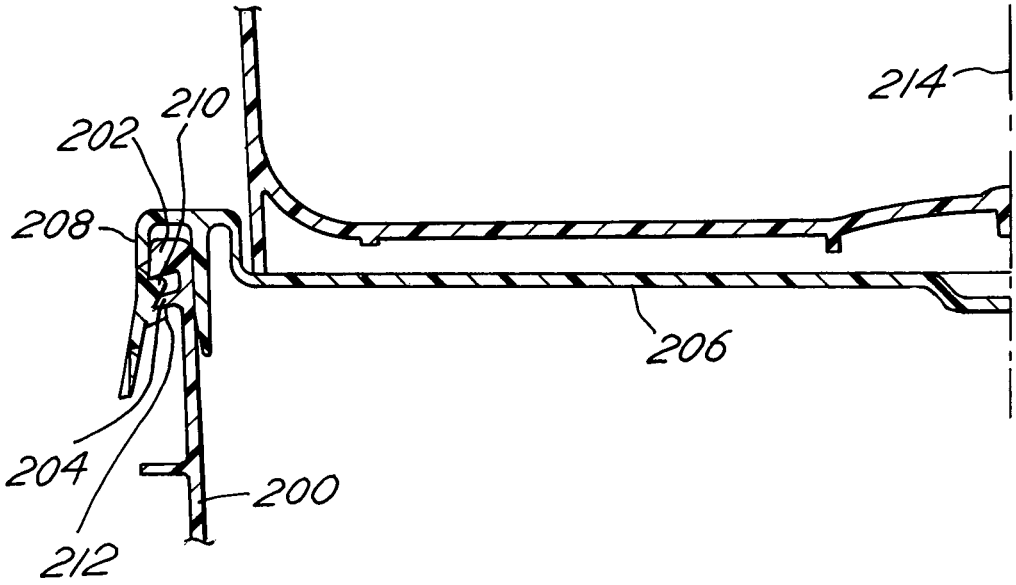
FIG. 14 is a cross sectional view of an alternative embodiment of the invention wherein portions of both an upper and a lower locking flange cooperative with an upper and lower rib of a container are removed by removal of a tear strip, the figure being a cross sectional view of the invention as incorporated in a generally cylindrical container.
Figure 15:
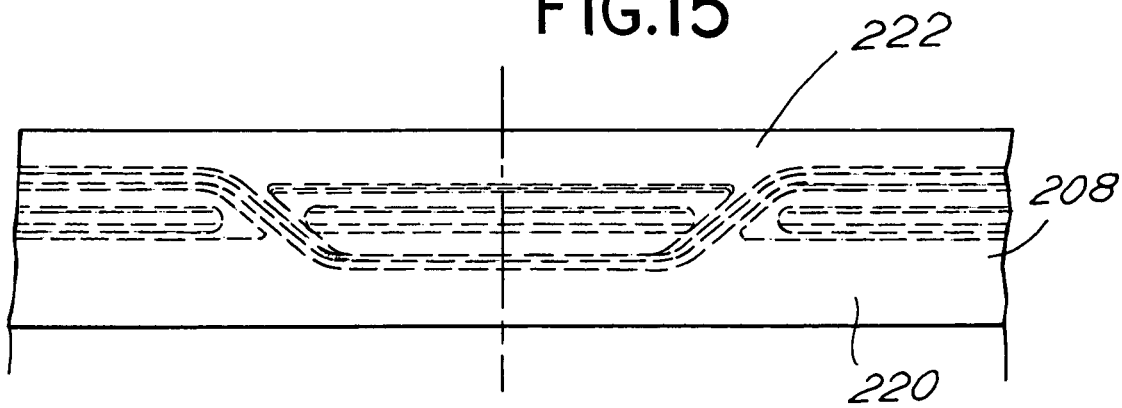
FIG. 15 is a partial plan view of the tear strip of FIG. 14.
Figure 16:
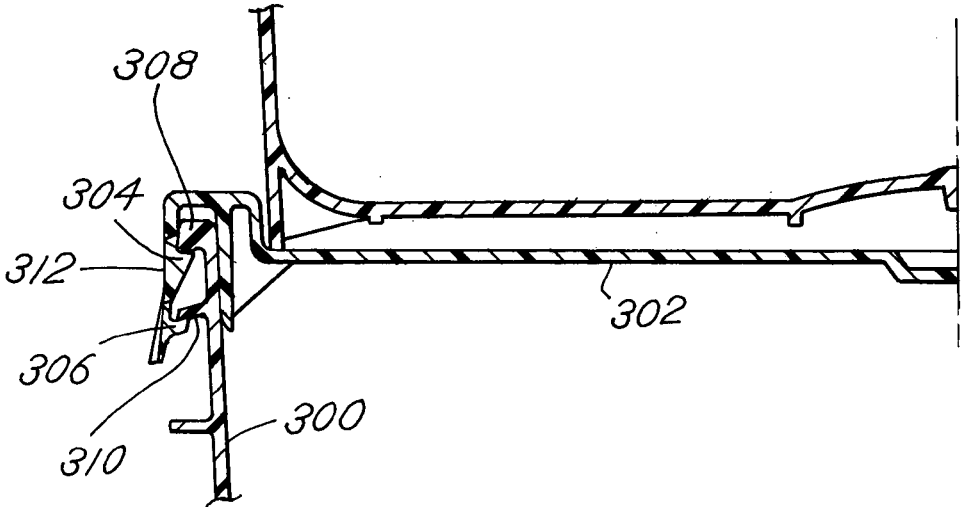
FIG. 16 is a side cross sectional view of a container including a bucket and lid which incorporates a further alternative embodiment of the invention wherein a tear strip removes portions of an upper flange and an entire lower flange cooperative respectively with an upper lid and a lower lid of a container.
Figure 17:
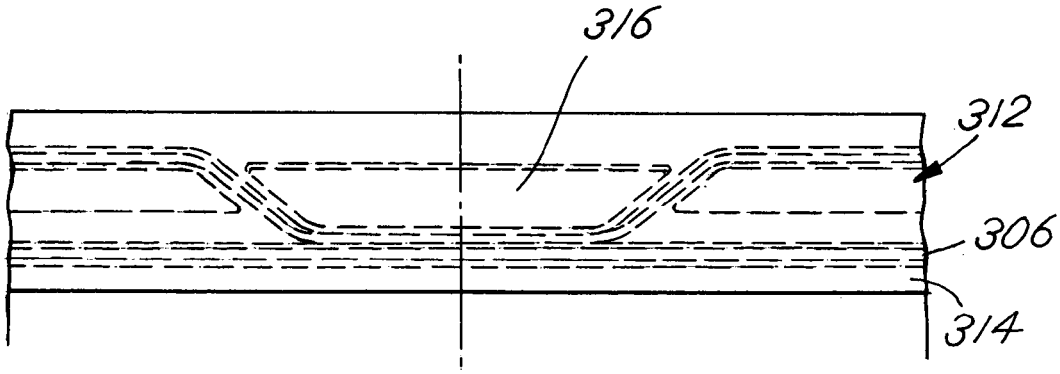
FIG. 17 is a partial plan view of the tear strip construction of FIG. 16.

FIGS. 14 and 15 illustrate a further embodiment of the invention. FIGS. 16 and 17 illustrate yet another embodiment of the invention.

The embodiment of FIGS. 14 and 15 comprises the combination of a bucket and lid wherein a tear strip removes portions of both an upper and lower locking flange associated with an upper and lower radially outwardly extending rib of a container. Thus, a cover or lid includes inwardly radially projecting locking flanges and the container includes outwardly extending ribs. A tear strip removes portions of both of the inwardly extending flanges in order to facilitate removal of the lid from the bucket.

FIGS. 16 and 17 illustrate the embodiment wherein the tear strip associated with the lid and the combination of first and second inwardly radially extending flanges effects removal of the entire lower flange and portions of the upper flange. Thus, upon removal of the tear strip, only portions of the upper flange or first flange associated with the lid remain engageable with the first outwardly extending rib associated with the container.

Referring again to FIGS. 14 and 15, there is depicted a bucket 200 having a first or top outwardly radially projecting rib 202 and a second spaced lower or second projecting rib 204. The rib 202 and 204 project radially outwardly along the upper rim of the container 200 and are designed for cooperation with inwardly projecting flanges of a cover or lid 206. The cover or lid 206 thus includes a downwardly depending skirt 208 having a first inwardly projecting flange 210 and a second spaced inwardly locking or projecting flange 212. The flanges 210 and 212 project radially inwardly and engage respectively with the ribs 202 and 204 to retain a lid 206 on the bucket or container 200. Note that FIG. 14 is a cross sectional view and is exemplified by a medial or vertical axis of symmetry 214. Thus, in the embodiment depicted, the container 200 and the lid 206 are generally cylindrical. However, the configuration of the container 200 and lid 206 is not a limiting feature of the invention. Other configurations such as polygonal, rectangular or the like may be utilized to incorporate the invention.

FIG. 15 illustrates the tear strip or skirt 208. The tear strip 208 is designed to be removable and thus includes a removable section or portion 220 and a permanent retention section or portion 222. Engaging a tab to effect removal of the removable portion 220 will effect removal of portions of both the upper and lower or first and second inwardly extending flanges 210 and 212. Thus, portions of the remaining skirt section 222 are available to engage portions of the outwardly projecting lids 202 and 204.

FIGS. 16 and 17 show an embodiment wherein the bucket or container 300 includes a lid 302 with inwardly projecting flanges 304 and 306 of the type previously described. The inwardly projecting flanges cooperate with outwardly projecting ribs 308 and 310, respectively. Downwardly depending skirt 312 includes a removable portion 314 and a permanent retained portion 316. Removal of the removable portion 314 effects removal of the entire lower or second flange 306 and retention of portions of the locking flange 308. In other words, removal of the tear strip removes portions of the upper flange 304 and the entirety of the lower flange 306.

Various other combinations of ribs, flanges, tear strips, and other elements as described may be utilized without departing from the spirit and scope of the invention. Thus, while there has been set forth preferred embodiments of the invention, it is to be understood that the invention is to be limited only by the following claims and equivalents thereof.

What is claimed is:

1. A bucket and removable lid construction comprising, in combination:

a bucket having a generally cylindrical side wall with an open top, said top including a first radially outwardly extending, circumferential top rib, said top rib including a top side and an underside, said bucket also including a second radially outwardly extending side rib vertically spaced from the underside of the first rib and including a second rib underside; and a lid including a center panel for covering the open top of the bucket, said lid further including a peripheral, annular section with an outer depending skirt, said outer skirt including: a first radially inwardly extending, locking flange for engaging against the underside of the bucket top rib, said skirt further including a second radially inwardly extending locking flange for engaging against the underside of the bucket second rib, said second locking flange spaced from said first locking flange approximately the distance of the spacing of the bucket ribs to enable the first and second locking flanges to retain the lid on the bucket, and said skirt further including a skirt extension from the second flange, said skirt and skirt extension including a tear strip to permit removal of portions thereof, said tear strip including portions of the first flange and second flange which are permanently removed from engagement with the first rib and second rib respectively upon removal of the tear strip, other portions of the first flange and the second flange remaining for engagement with the first rib and the second rib respectively upon removal of the tear strip.

2. The combination of claim 1 wherein the top of the bucket includes a groove extending at least partially around the circumference of the bucket and the lid peripheral section includes an inside face having a downwardly depending tongue for engaging said groove.

3. The construction of claim 1 wherein the tear strip includes an end tab for manual gripping.

4. The combination of claim 1 wherein the bucket first rib includes an inside wall and outside wall radially spaced outwardly from the inside wall, and said lid further includes an inner hoop spaced radially inward from the outer skirt, said inner hoop and outer skirt respectively engaging the inside wall and outside wall of the top rib.

5. The combination of claim 1 wherein the bucket side wall further includes a third radially outwardly extending side rib spaced from the second side rib and wherein the skirt of the lid further includes a third radially inwardly extending flange for engaging the third bucket rib.

6. The combination of claim 5 wherein the third bucket wall rib includes a top side and the third flange of the skirt engages the third bucket rib top side.

7. The combination of claims 1 or 5 wherein the lid flanges include inclined surfaces, whereby placement or removal of the lid from the bucket is facilitated.

8. The combination of claim 1 wherein the bucket and lid are molded plastic.

9. The combination of claim 1 wherein the lid skirt is elastic.

10. The construction of claim 1 wherein the lid includes a depending inner flange spaced from the skirt and sealingly engaged against the inner side wall of the bucket when the lid is on the bucket.

11. The construction of claim 1 wherein the lid includes at least a first circular hoop spaced radially inward from the skirt and generally parallel to the skirt.

12. The construction of claim 1 wherein the lid includes a first circular hoop spaced radially inward from the skirt and a second circular hoop spaced radially inward from the first circular hoop.

13. The construction of claim 12 wherein the first circular hoop fits against the inside wall of the bucket.

14. The construction of claims 11, 12 or 13 including reinforcing fillets connecting at least two of the hoops.

15. A container and removable lid construction comprising, in combination:

a container having a side wall with an open top, said top including a first outwardly extending top rib, said top rib including a top side and an underside, said container also including a second outwardly extending side rib vertically spaced from the first rib and having an underside; and a lid for covering the open top of the container, said lid including a peripheral, depending outer skirt, said outer skirt including:

(a) a first inwardly extending, circumferential locking flange for engaging against the underside of the container top rib, (b) a second inwardly extending, circumferential locking flange for engaging against the underside of the second container side rib, said second locking flange spaced from the first locking flange approximately the distance of the spacing of the container side ribs to enable the locking flanges to retain the lid on the container, and (c) a skirt extension from the second locking flange, said skirt extension comprising a tear strip of material from the skirt including selected portions of said first and said second locking flange.

16. The construction of claim 15 wherein the tear strip includes alternating parts of the second locking flange and the skirt extension.

17. The construction of claim 15 wherein the tear strip includes an end tab for manual gripping.

18. The construction of claim 15 in combination with a tongue and groove seal between the lid and top side of the top rib of the container.

19. A bucket and removable lid construction comprising, in combination:

a bucket having a generally cylindrical side wall with an open top, said top comprising a first radially outwardly extending circumferential top rib, said top rib including a top side and an underside, said bucket also including a second radially outwardly extending side rib vertically spaced from the underside of the first rib and including a second rib underside; and a lid for covering the open top of the bucket, said lid including a peripheral, annular section with an outer depending skirt, said outer skirt including:

a first radially inwardly extending, elastically deformable circumferential locking flange for engaging against the underside of the bucket top rib, said skirt further including a second radially inwardly extending, elastically deformable locking flange for engaging against the underside of the bucket second rib, said second locking flange spaced from said first locking flange approximately the distance of the spacing of the bucket ribs to enable the first and second locking flanges to retain the lid on the bucket, and said skirt further including a skirt extension from the second flange, said skirt and skirt extension including a tear boundary to define a tear strip for removal from the lid, said tear strip including portions of the first and the second flange which are permanently removed from engagement with the second rib upon removal of the tear strip, other portions of the first and the second flange remaining for engagement with the first and the second ribs respectively upon removal of the tear strip.

20. The combination of claim 19 wherein the top side of the first rib includes a groove extending at least partially around the circumference of the bucket, and the lid peripheral section includes an inside face having a downwardly depending tongue for engaging and sealing said groove.

21. The combination of claim 19 wherein the bucket first rib includes an inside wall and outside wall radially spaced outwardly from the inside wall, and said lid further includes an inner hoop spaced radially inward from the outer skirt, said inner hoop and outer skirt respectively engaging the inside wall and outside wall of the top rib.

22. The combination of claim 19 wherein the bucket side wall further includes a third radially outwardly extending side rib spaced from the second side rib and wherein the skirt of the lid further includes a third radially inwardly extending flange for engaging the third bucket rib.

23. The combination of claim 22 wherein the third bucket wall rib includes a top side and the third flange of the skirt engages the third bucket rib top side.

24. The combination of claim 19 wherein the lid flanges include inclined surfaces, whereby placement or removal of the lid from the bucket is facilitated.

25. The combination of claim 19 wherein the bucket and lid comprise molded plastic material.

26. A bucket and removable lid construction comprising, in combination:

a bucket having a generally cylindrical side wall with an open top, said top including a first radially outwardly extending, circumferential top rib, said top rib including a top side and an underside, said bucket also including a second radially outwardly extending side rib vertically spaced from the underside of the first rib and including a second rib underside; and a lid including a center panel for covering the open top of the bucket, said lid further including a peripheral, annular section with an outer depending skirt, said outer skirt including: a first radially inwardly extending, locking flange for engaging against the underside of the bucket top rib, said skirt further including a second radially inwardly extending locking flange for engaging against the underside of the bucket second rib, said second locking flange spaced from said first locking flange approximately the distance of the spacing of the bucket ribs to enable the first and second locking flanges to retain the lid on the bucket, and said skirt further including a skirt extension from the second flange, said skirt and skirt extension including a tear strip to permit removal of portions thereof, said tear strip including portions of the first flange and the entire second flange which are permanently removed from engagement with the first rib and second rib respectively upon removal of the tear strip, other portions of the first flange remaining for engagement with the first rib upon removal of the tear strip.

27. The combination of claim 26 wherein the top of the bucket includes a groove extending at least partially around the circumference of the bucket and the lid peripheral section includes an inside face having a downwardly depending tongue for engaging said groove.

28. The construction of claim 26 wherein the tear strip includes an end tab for manual gripping.

29. The combination of claim 26 wherein the bucket first rib includes an inside wall and outside wall radially spaced outwardly from the inside wall, and said lid further includes an inner hoop spaced radially inward from the outer skirt, said inner hoop and outer skirt respectively engaging the inside wall and outside wall of the top rib.

30. The combination of claim 26 wherein the bucket side wall further includes a third radially outwardly extending side rib spaced from the second side rib and wherein the skirt of the lid further includes a third radially inwardly extending flange for engaging the third bucket rib.

31. The combination of claim 30 wherein the third bucket wall rib includes a top side and the third flange of the skirt engages the third bucket rib top side.

32. The combination of claims 26 or 30 wherein the lid flanges include inclined surfaces, whereby placement or removal of the lid from the bucket is facilitated.

33. The combination of claim 26 wherein the bucket and lid are molded plastic.

34. The combination of claim 26 wherein the lid skirt is elastic.

35. The construction of claim 26 wherein the lid includes a depending inner flange spaced from the skirt and sealingly engaged against the inner side wall of the bucket when the lid is on the bucket.

36. The construction of claim 26 wherein the lid includes at least a first circular hoop spaced radially inward from the skirt and generally parallel to the skirt.

37. The construction of claim 26 wherein the lid includes a first circular hoop spaced radially inward from the skirt and a second circular hoop spaced radially inward from the first circular hoop.

38. The construction of claim 37 wherein the first circular hoop fits against the inside wall of the bucket.

39. The construction of claims 36, 37 or 38 including reinforcing fillets connecting at least two of the hoops.

40. A container and removable lid construction comprising, in combination:

a container having a side wall with an open top, said top including a first outwardly extending top rib, said top rib including a top side and an underside, said container also including a second outwardly extending side rib vertically spaced from the first rib and having an underside; and a lid for covering the open top of the container, said lid including a peripheral, depending outer skirt, said outer skirt including:

(a) a first inwardly extending, circumferential locking flange for engaging against the underside of the container top rib, (b) a second inwardly extending, circumferential locking flange for engaging against the underside of the second container side rib, said second locking flange spaced from the first locking flange approximately the distance of the spacing of the container side ribs to enable the locking flanges to retain the lid on the container, and (c) a skirt extension from the second locking flange, said skirt extension comprising a tear strip of material from the skirt including selected portions of said first locking flange and the entirety of the second locking flange.

41. The construction of claim 40 wherein the tear strip includes alternating parts of the second locking flange and the skirt extension.

42. The construction of claim 40 wherein the tear strip includes an end tab for manual gripping.

43. The construction of claim 40 in combination with a tongue and groove seal between the lid and top side of the top rib of the container.

44. A bucket and removable lid construction comprising, in combination:

a bucket having a generally cylindrical side wall with an open top, said top comprising a first radially outwardly extending circumferential top rib, said top rib including a top side and an underside, said bucket also including a second radially outwardly extending side rib vertically spaced from the underside of the first rib and including a second rib underside; and a lid for covering the open top of the bucket, said lid including a peripheral, annular section with an outer depending skirt, said outer skirt including:

a first radially inwardly extending, elastically deformable circumferential locking flange for engaging against the underside of the bucket top rib, said skirt further including a second radially inwardly extending, elastically deformable locking flange for engaging against the underside of the bucket second rib, said second locking flange spaced from said first locking flange approximately the distance of the spacing of the bucket ribs to enable the first and second locking flanges to retain the lid on the bucket, and said skirt further including a skirt extension from the second flange, said skirt and skirt extension including a tear boundary to define a tear strip for removal from the lid, said tear strip including portions of the first flange which are permanently removed from engagement with the first rib upon removal of the tear strip, other portions of the first flange remaining for engagement with the first rib upon removal of the tear strip, said second flange being entirely removable with the tear strip upon removal of the tear strip.

45. The combination of claim 44 wherein the top side of the first rib includes a groove extending at least partially around the circumference of the bucket, and the lid peripheral section includes an inside face having a downwardly depending tongue for engaging and sealing said groove.

46. The combination of claim 44 wherein the bucket first rib includes an inside wall and outside wall radially spaced outwardly from the inside wall, and said lid further includes an inner hoop spaced radially inward from the outer skirt, said inner hoop and outer skirt respectively engaging the inside wall and outside wall of the top rib.

47. The combination of claim 44 wherein the bucket side wall further includes a third radially outwardly extending side rib spaced from the second side rib and wherein the skirt of the lid further includes a third radially inwardly extending flange for engaging the third bucket rib.

48. The combination of claim 44 wherein the third bucket wall rib includes a top side and the third flange of the skirt engages the third bucket rib top side.

49. The combination of claim 44 wherein the lid flanges include inclined surfaces, whereby placement or removal of the lid from the bucket is facilitated.

50. The combination of claim 44 wherein the bucket and lid comprise molded plastic material.

* * * * *